United States Patent [19]

Van Alphen et al.

[11] Patent Number: 4,907,175

[45] Date of Patent: Mar. 6, 1990

[54] MONITORING DEVICE

[75] Inventors: Antonius W. C. M. Van Alphen, Breda; Erwin Hogeweg, Eindhoven, both of Netherlands

[73] Assignee: U.S. Philips Corporation, New York, N.Y.

[21] Appl. No.: 145,849

[22] Filed: Jan. 19, 1988

[30] Foreign Application Priority Data

Jan. 19, 1987 [NL] Netherlands ..... 8700110

[51] Int. Cl.[4] ..... G08B 13/18; G08B 13/24

[52] U.S. Cl. ..... 364/550; 340/552; 340/556

[58] Field of Search ..... 364/550; 340/550, 552, 340/556, 557, 558

[56] References Cited

U.S. PATENT DOCUMENTS

| | | | |
|---|---|---|---|
| 4,124,848 | 11/1978 | Clark et al. | 340/552 |
| 4,166,273 | 8/1979 | Riley, Jr. et al. | 340/552 |
| 4,225,859 | 9/1980 | Zetting et al. | 340/550 |
| 4,605,922 | 8/1986 | Blattman et al. | 340/552 |
| 4,760,381 | 7/1988 | Haag | 340/556 |

FOREIGN PATENT DOCUMENTS

| | | | |
|---|---|---|---|
| 26383 | 4/1981 | European Pat. Off. | 364/550 |
| 26385 | 4/1981 | European Pat. Off. | 364/550 |

*Primary Examiner*—Felix D. Gruber
*Attorney, Agent, or Firm*—Paul R. Miller

[57] ABSTRACT

A monitoring device comprises a transmitter and a receiver for transmitting and receiving, respectively, a signal in a medium to be monitored. During a cycle of m sampling periods n sampling values are taken of the signal received during each sampling period. After completion of each cycle a series of n means sampling values is determined by determining a mean value from the m sampling values taken at corresponding instants in the sampling periods. This series forms an actual pattern word which is sub-divided into sub-pattern words, each sub-pattern word being combined with a corresponding sub-pattern word from a reference pattern word in order to form a combination word. The combination word is translated into a code number which is selected from a predetermined series of code numbers. The code number assigned characterizes the time shift of the actual sub-pattern word with respect to the reference pattern word. For each cycle there is determined a series of sum numbers which represent how many times each code number has been assigned. This series of sum numbers is tested with respect to a criterion. If one or more sum numbers of the series exceeds the limit value given, a signal is generated, for example an alarm signal.

38 Claims, 8 Drawing Sheets

| TO \ FRM | 000 | 001 | 010 | 011 | 100 | 101 | 110 | 111 |
|---|---|---|---|---|---|---|---|---|
| 000 | $V_6$ | $V_4$ | $V_4$ | $V_4$ | $V_4$ | $V_4$ | $V_4$ | 3 |
| 001 | $V_5$ | 0 | -2 | -1 | +2 | +1 | +3 | $V_5$ |
| 010 | $V_5$ | 2 | 0 | +1 | -2 | 3 | -1 | $V_5$ |
| 011 | $V_5$ | 1 | -1 | 0 | 3 | +2 | -2 | $V_5$ |
| 100 | $V_5$ | -2 | +2 | 3 | 0 | -1 | +1 | $V_5$ |
| 101 | $V_5$ | -1 | 3 | -2 | +1 | 0 | +2 | $V_5$ |
| 110 | $V_5$ | 3 | +1 | +2 | -1 | -2 | 0 | $V_5$ |
| 111 | 3 | $V_4$ | $V_4$ | $V_4$ | $V_4$ | $V_4$ | $V_4$ | $V_6$ |

MONITORING DEVICE

The invention relates to a monitoring device, comprising a central unit whereto there are connected a transmitter for periodically transmitting a pulse train into a medium to be monitored and a receiver for receiving the pulse train which is transported by the medium and which is formed by a wave group, which central unit comprises a control member for controlling the monitoring device and a sampling unit which is connected to the receiver for taking, in correlation with the transmission of the pulse train and each time within a sampling cycle, a series of n ($n>3$) sampling values from the wave group received, and for forming an actual pattern word from said series, which control member is connected to a signal generator and comprises a reference memory for storing a reference pattern word formed during a preceding cycle, which control member also comprises a control unit which is connected to the reference memory and which comprises a comparator.

A monitoring device of this kind is known from European patent application No. 0,026,383. The known monitoring device is formed by an alarm device which comprises a transmitter which transmits a pulse train into the medium which is formed by glass. The wave group received by the receiver is sampled by means of the sampling unit. During such a sampling period, n samples of the signal received are taken. In order to remove, using averaging, interference signals which are not relevant for the detection of an alarm situation, sampling is cyclically repeated in cycles of m sampling periods. After termination of each cycle, a series of n mean sampling values is determined by determining each time a mean value from the m sampling values taken at corresponding instants. The series thus determined forms an actual pattern word which is subsequently compared with a reference pattern word. The reference pattern word is formed, for example during a preceding cycle or is formed by a reference pattern word representing a non-disturbed signal received. When comparison by the comparator reveals that the actual pattern word and the reference pattern word do not correspond, the signal generator is activated so as to generate an alarm signal.

It is a drawback of the known monitoring device that the risk of a false alarm is high because a simple comparison does not adequately take into account a variety of changes liable to occur in the signal received. Such changes do not necessarily imply an alarm situation; they could be due to temperature fluctuations, fluctuations in the relative humidity of the medium, or other external factors.

It is the object of the invention to provide a monitoring device in which the risk of false alarm is negligibly small and in which said variety of changes can be detected and taken into account.

To achieve this, a monitoring device in accordance with the invention is characterized in that the control unit is also suitable for sub-dividing the period of the wave group received into a further number of n/j ($j>1$) sub-periods and for sub-dividing the actual pattern word and the reference pattern word into n/j j-bit first sub-pattern words and second sub-pattern words, respectively, each j-bit sub-pattern word representing a signal component in a respective sub-period of the wave group, a comparator is suitable for forming each time a combination word from a first sub-pattern word and a second sub-pattern word originating from corresponding sub-periods, which comparator also comprises a code number generator for assigning a code number from a predetermined series of code numbers to each combination word, which code numbers represent a respective measure of the shift in time of the signal components, as represented by the first sub-pattern word of their respective combination word, with respect to the signal component as represented by the second sub-pattern word of their respective combination word, which control member also comprises a counter system which is connected to the code number generator and which is suitable for determining for each of the code numbers a first sum number which indicates the number of times that the relevant code number has been assigned within one and the same cycle, which control unit is also suitable for checking whether the first sum numbers exceed limit values given by a predetermined criterion and for activating the signal generator when the criterion is exceeded.

The wave group received is sub-divided into sub-periods in order to take into account the signal component within each of the sub-periods. Such a signal component is represented by a j-bit sub-pattern word which is obtained by sub-dividing the n-bit pattern word in the same manner as used for the sub-division into the sub-periods. The first sub-pattern word each time identifies a sub-period of the actual wave group received and the second sub-pattern word each time identifies a corresponding sub-period of a reference signal which is preferably formed by the wave group received during the preceding cycle. The extent of the shift in time of the signal component as represented by the first sub-pattern word with reference to the signal component as represented by the second sub-pattern word is now given by the code number assigned to the combination word. By using also the first sum numbers, each of which indicates how many times their associated code number has occurred, and by testing the sub-numbers on the basis of a criterion, an accurate impression can be obtained as regards which shifts in time have occurred in the actual wave group with respect to the selected reference. Thus, the signal generator is activated only if predetermined limit values are exceeded by one or more first sum numbers. Utilizing the monitoring device in accordance with the invention, shifts in time can be distinguished from one another. The possibility of making a distinction in these shifts enables more accurate detection and substantially reduces the risk of a false alarm.

A first preferred embodiment of a monitoring device in accordance with the invention is characterized in that the control unit comprises a ratio factor generator for determining a ratio factor from the ratio of the first sum numbers associated with code numbers representing an advancement in time and the first sum numbers associated with code numbers representing a retardation, which control unit is also suitable for forming a second sum number by summing the sum values associated with code numbers representing shifts in a predetermined time interval, which control unit is also suitable for forming a combination number from the second sum number and the ratio factor and for activating the signal source if said combination number forms part of a predetermined number of combination numbers. The combination number enables simple testing of the first sum numbers with respect to the criterion. The ratio factor characterizes the direction of the shifts in time, while the second sum number provides an impression of the magnitude of the shifts.

A second embodiment of a monitoring device in accordance with the invention is characterized in that the pulse train to be transmitted is composed of a mainly sinusoidal wave pattern, the shifts in time as represented by the code numbers representing each time a phase shift within a predetermined phase range. Phase shifts occurring in mainly sinusoidal signals can be simply detected so that shifts in time can also be simply detected.

Preferably, the phase range is sub-divided into regions of each time 60° ($\pi/3$), a sub-pattern word being associated with each region thus formed. As a result, the series of code numbers is limited and reliable detection is still possible.

A third preferred embodiment of a monitoring device in accordance with the invention is characterized in that the control member comprises a memory in which indicators are stored in memory locations which can be addressed by combination numbers, which indicators represent each time an activation signal for the signal source. Testing with respect to the criterion is thus simple.

Preferably, the code number generator comprises a further memory in which the series of code numbers are stored and which can be addressed by an address formed by the combination word. The assignment of the code number is thus simply implemented.

When the control member comprises a mean value determining device for forming, each time after completion of a cycle of m ($m>1$) sampling periods, a further series of n mean sampling values by determining a mean value from the sampling values taken in the corresponding sub-periods of each of the m sampling periods of the same cycle, and for forming the actual pattern word from said further series, the mean value determining device preferably comprises a register memory having n memory locations, an address generator for generating, in synchronism with the taking of each of the $k^{th}$ ($1 \leqq k \leqq n$) sampling value by the sampling unit, each time a $k^{th}$ address for addressing the $k^{th}$ memory location of the register memory, and a counter which is connected to a data port of said register memory and to an output of the sampling unit, which mean value forming device is suitable for presenting, in response to the presentation of a sampling value originating from the sampling unit, the contents of the addressed memory location to the counter which is suitable for adding the sampling value presented to said contents presented, which mean value determining device is also suitable for storing the addition result of the counter at the addressed memory location. As a result, the mean value can be quickly and simply determined.

Preferably, the sampling frequency amounts to three times the pulse frequency of the transmitted pulse train. This enables the assignment of reliable code numbers.

Preferably, said series of code numbers comprises a first code number which represents the disappearance of the wave group received and a second code number which represents a phase jump in a signal component in the wave group received, the control unit being suitable for activating a warning signal if within a cycle said first or second code number has occurred a number of times which exceeds a predetermined number. Phase jumps and the disappearance of the signal received can thus also be taken into account.

A fourth preferred embodiment of a monitoring device in accordance with the invention is characterized in that the control unit comprises an amplitude control signal generator for generating a series of amplitude control signals, each control signal of the series indicating a well-defined amplitude of the pulses of the pulse train to be transmitted, which monitoring device comprises a control circuit, a control input of which is connected to the amplitude control signal generator in order to receive amplitude control signals, an output thereof being connected to the transmitter, which control circuit comprises adjusting means for adjusting, under the control of a control signal received, the pulse amplitude of the pulse train to be transmitted to a level indicated by the control signal received, which control unit is suitable for verifying, during an adjustment phase of the monitoring device, whether an amplitude adjusted by means of a selected amplitude control signal will lead to the predetermined criterion being exceeded, and for selecting, when the criterion is exceeded, a further amplitude control signal which represents a higher amplitude. The use of the control circuit and the control unit offers automatic adjustment of the amplitude of the pulse train to be transmitted. Each time when it is detected during the set-up phase that the selected amplitude directly leads to the criterion being exceeded, the amplitude of the pulse train to be transmitted is increased by selection of a further amplitude control signal and it is checked again whether the new amplitude value again leads to the criterion being exceeded. Thus, a suitable amplitude for the medium is automatically selected.

A fifth preferred embodiment of a monitoring device in accordance with the invention is characterized in that the control unit comprises a re-adjustment unit which comprises a first counter for counting the total number of times that code numbers representing a shift in time which deviates from zero have occurred within a number of cycles, which re-adjustment unit is connected to the amplitude control signal generator and is suitable for selecting an amplitude control signal indicating a lower and a higher amplitude, respectively, if said total number of times within a further predetermined number of cycles is smaller and larger, respectively, than a predetermined number. The use of a re-adjustment unit offers the possibility of adapting the amplitude of the pulse train to be transmitted to changing circumstances during operation of the monitoring device for example to temperature fluctuations.

The invention will be described in detail hereinafter with reference to the drawings; therein:

Figures 1, 4:
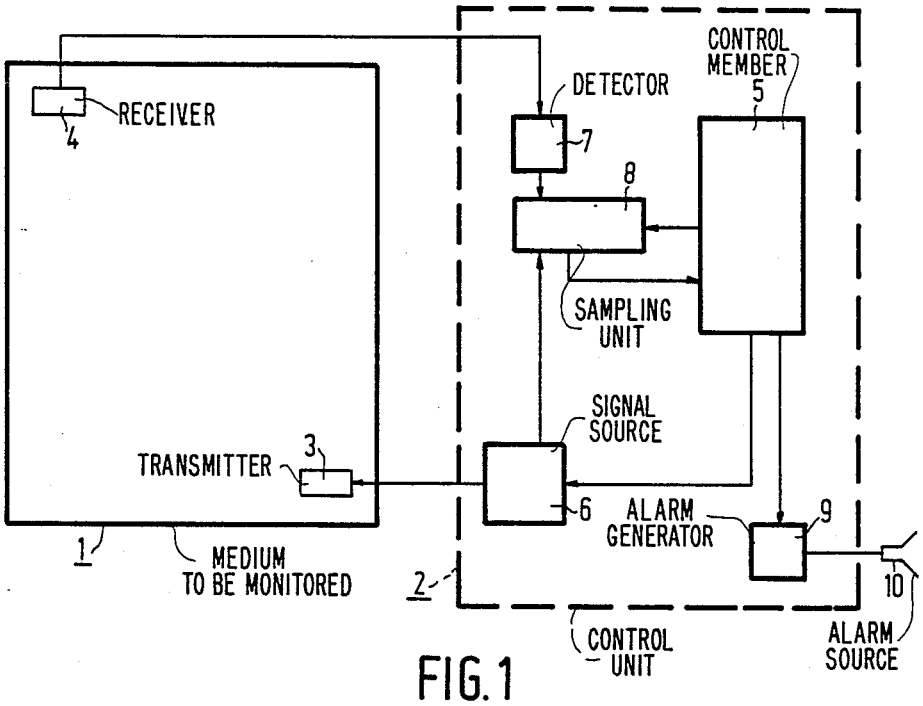
FIG. 1 shows an embodiment of a monitoring device in accordance with the invention.
Figure 2:
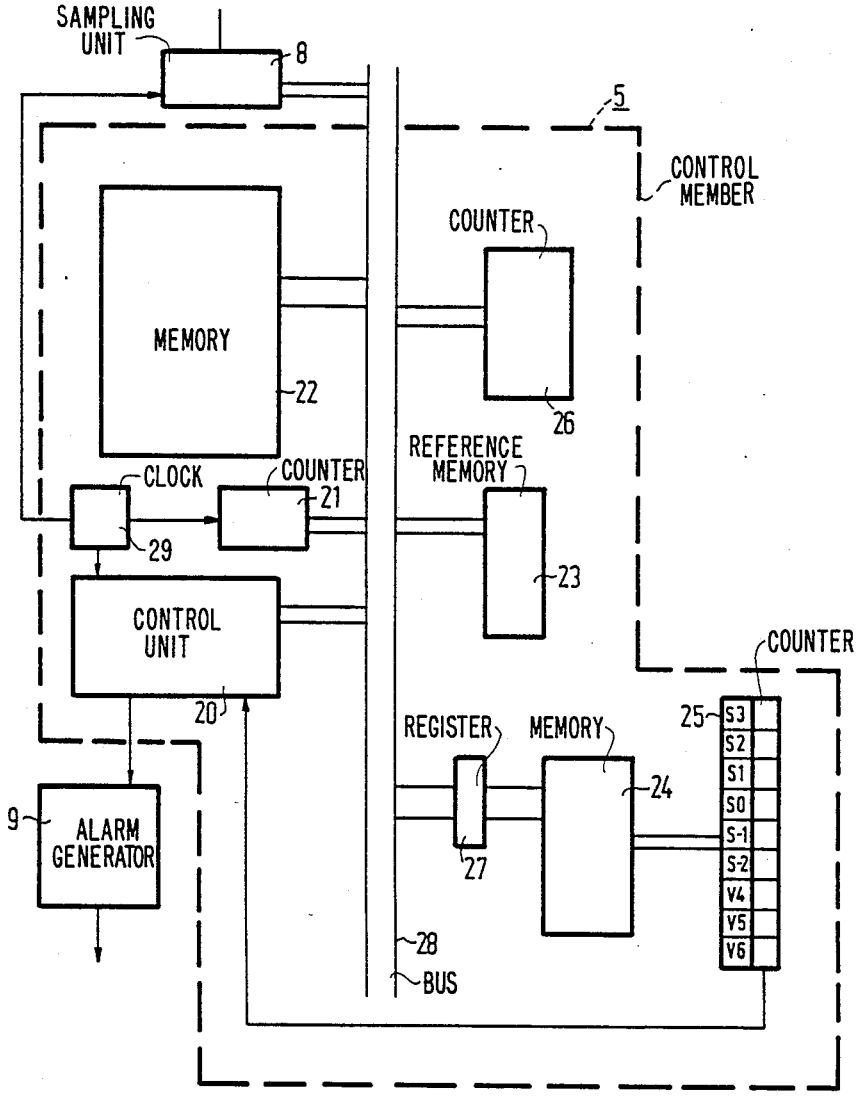
FIG. 2 shows an embodiment of a control member for a monitoring device in accordance with the invention.
Figure 2A:
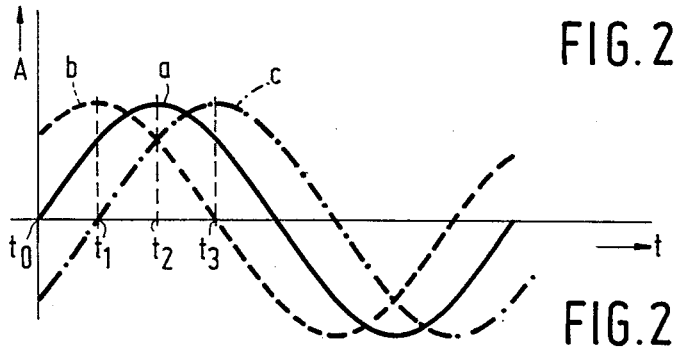
Figure 3:
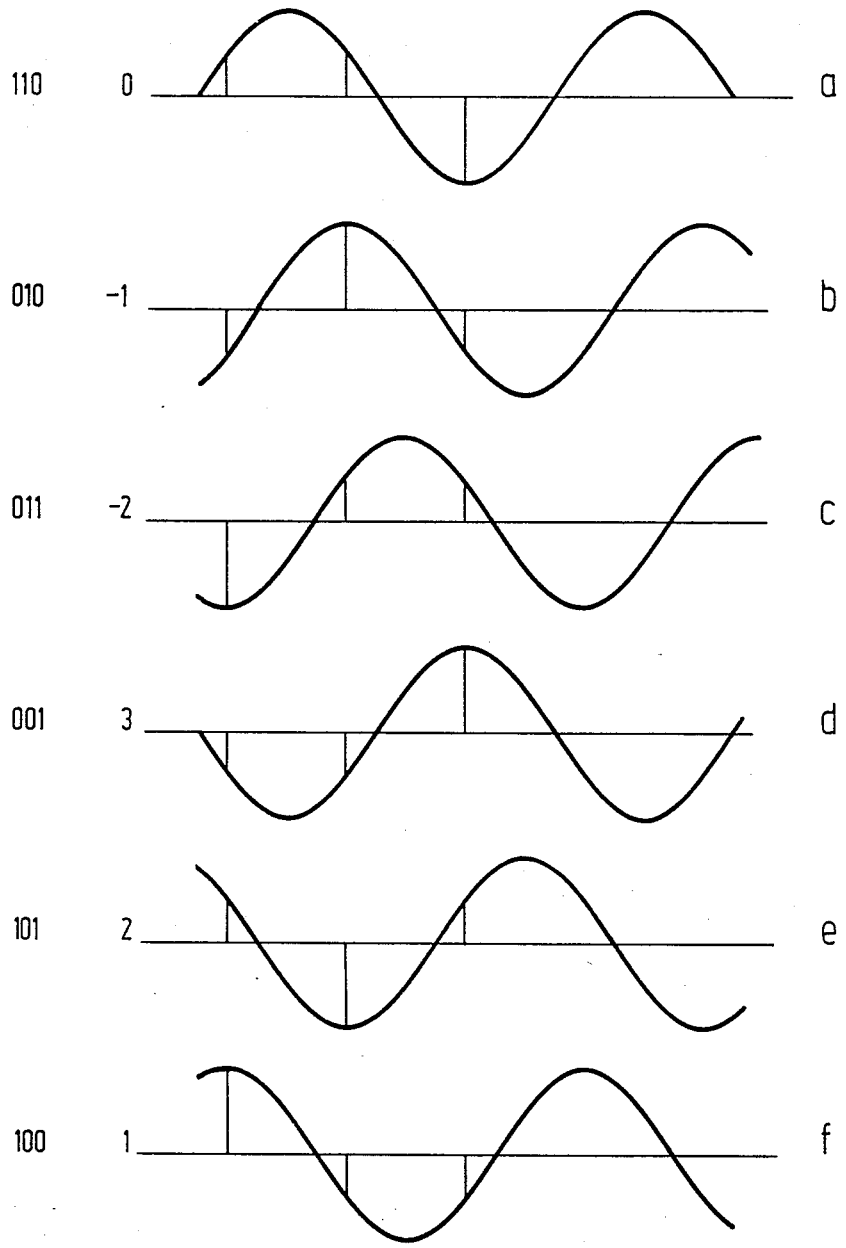
Figure 5:
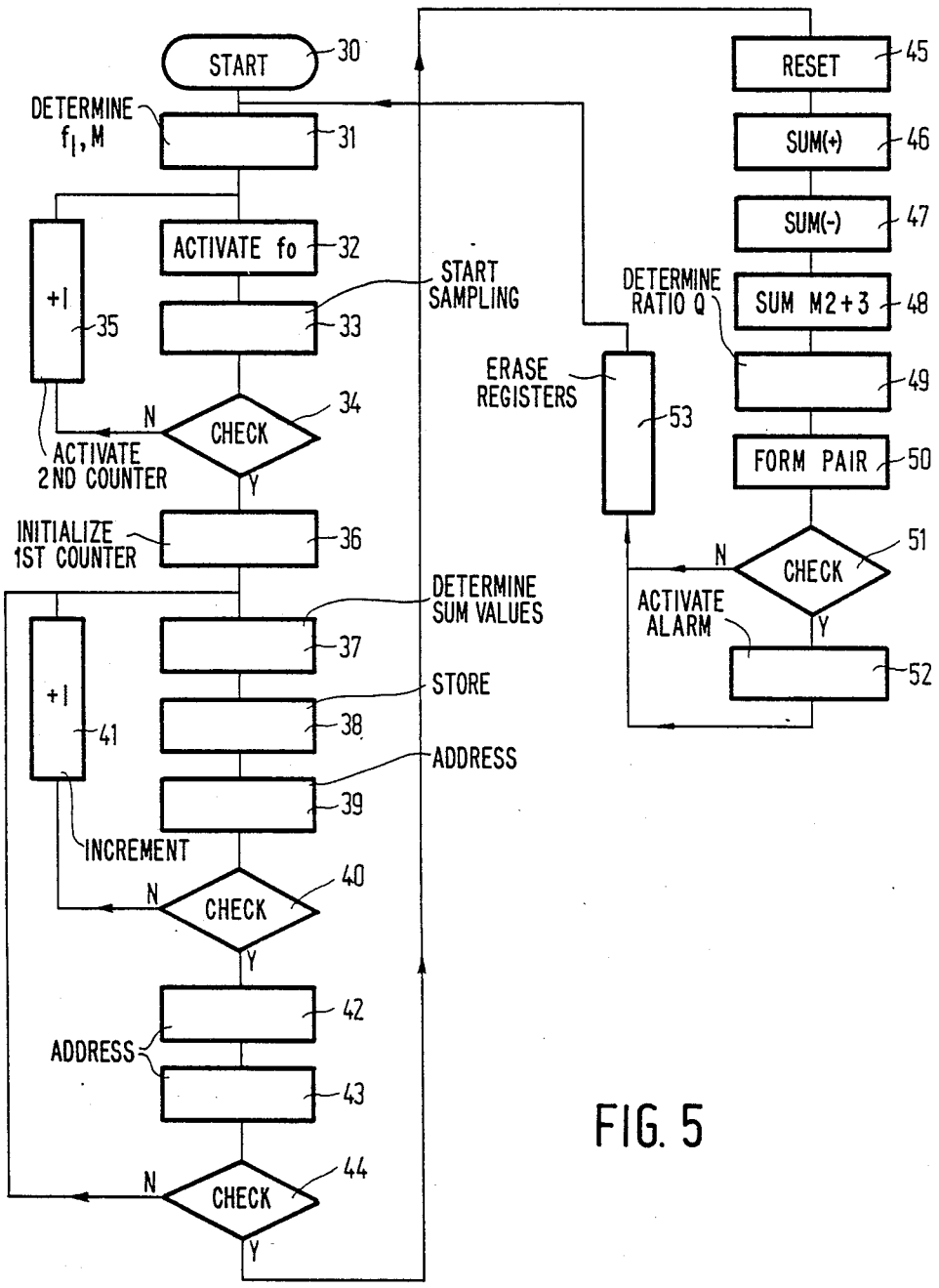
Figure 6:
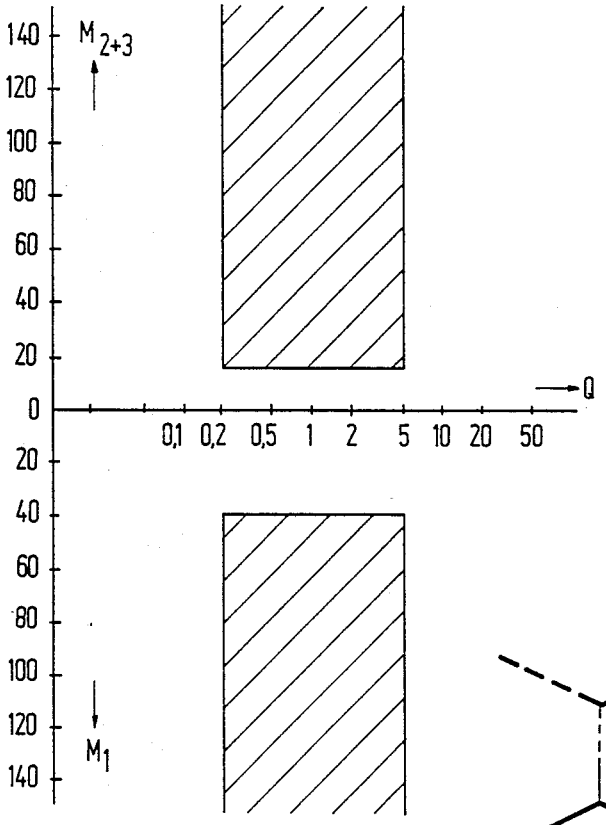
Figure 7:
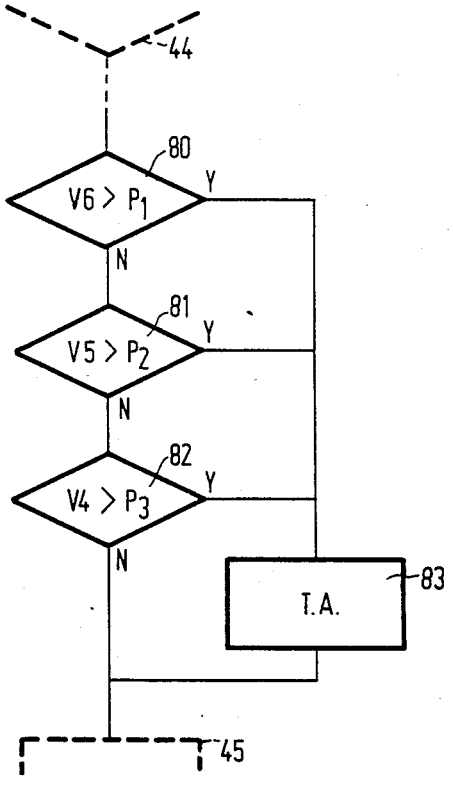
Figure 8:
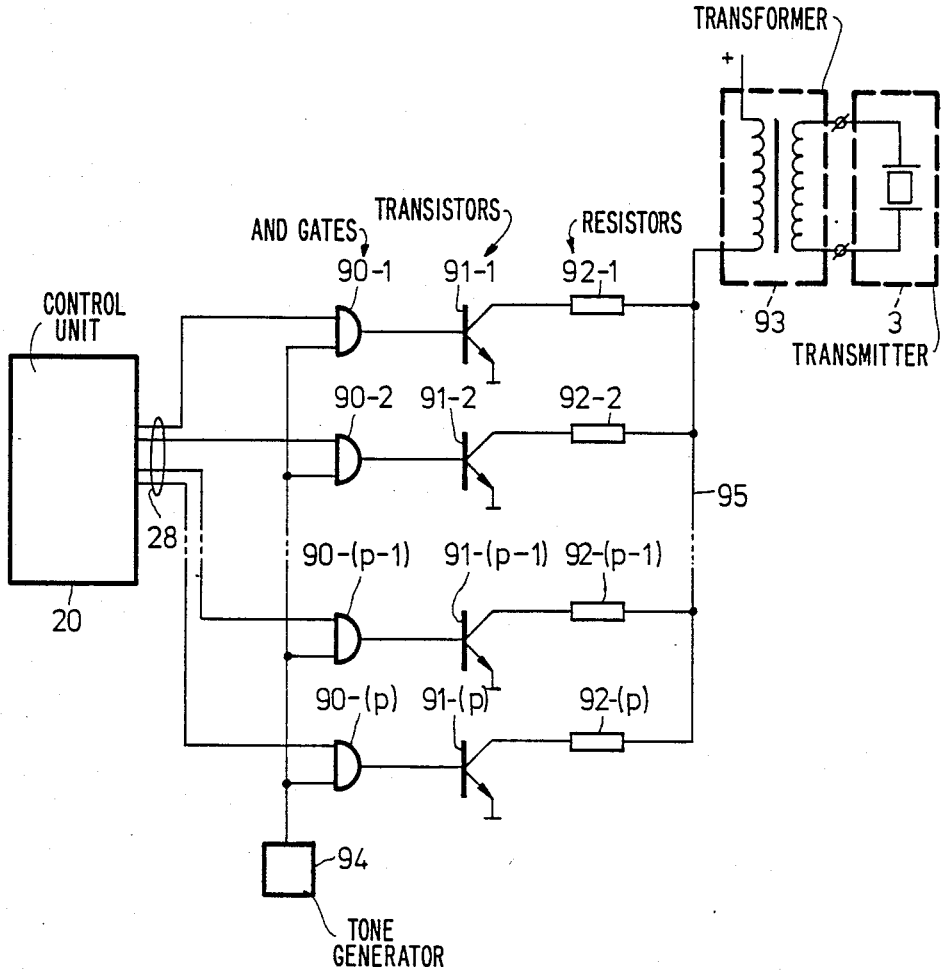
Figure 9:
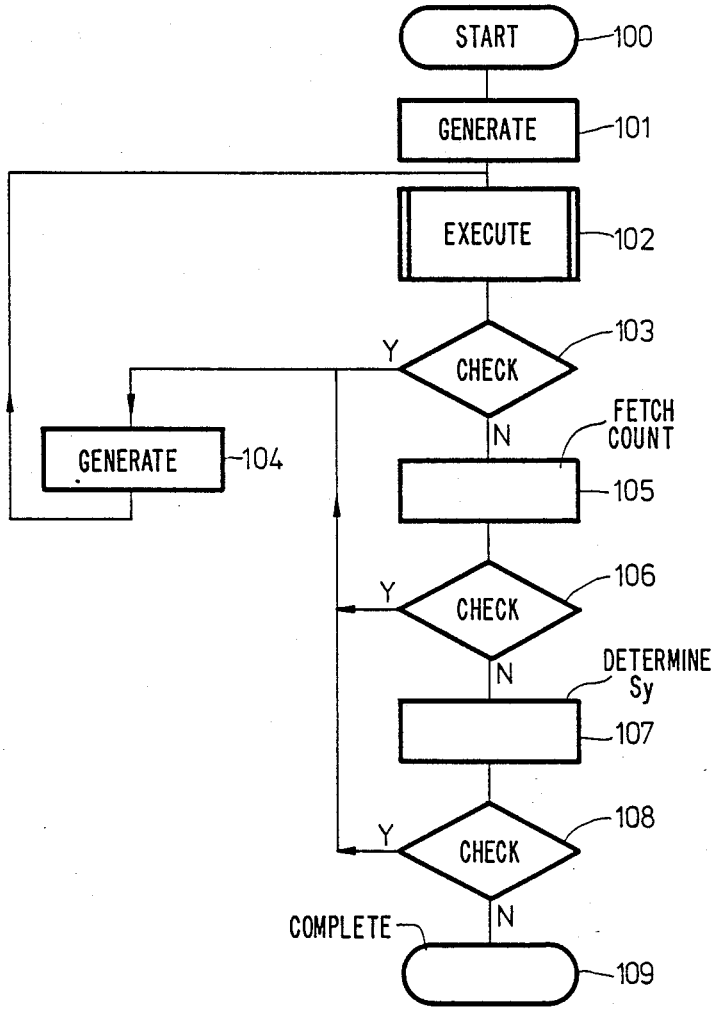
Figure 10:
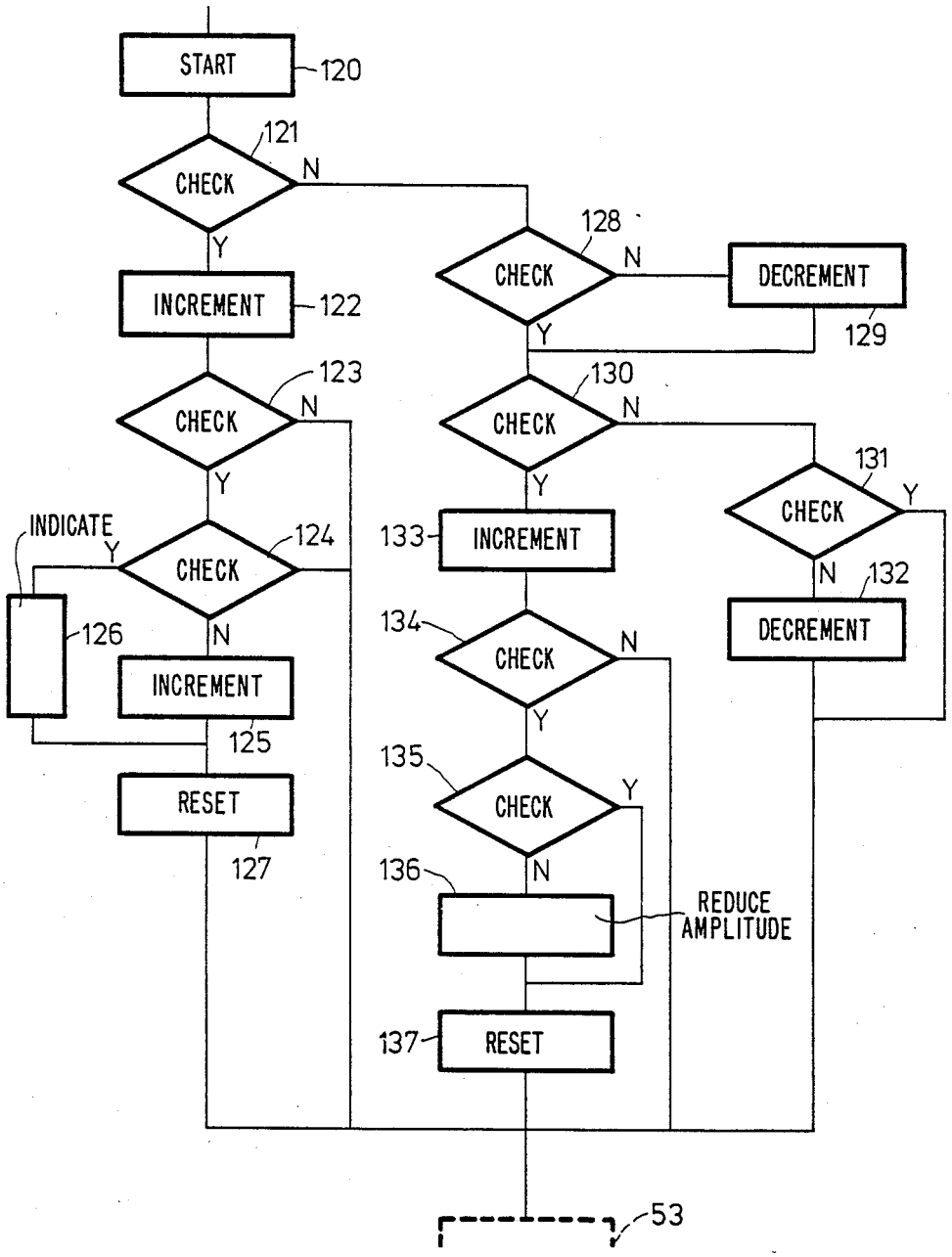

FIG. 2*a* illustrates a shift in time of a signal component of a wave group;

FIG. 3 (*a–f*) shows six sinusoidal waves, each of which has been shifted 60° in phase with respect to its predecessor;

FIG. 4 shows a table of code numbers;

FIG. 5 shows a flowchart representing a control program for the control of the monitoring device;

FIG. 6 illustrates a detection criterion;

FIG. 7 shows an extension to the control program;

FIG. 8 shows a control circuit for adjusting the amplitude of the pulses of the transmitted pulse train;

FIG. 9 shows a flowchart of an initialization routine for adjusting the pulse amplitude; and FIG. 10 shows a flowchart of a re-adjustment program.

A monitoring device which acts as an alarm device is chosen as an example for the purpose of the description.

FIG. 1 shows an embodiment of an alarm device in accordance with the invention. The medium 1 on which or in which the alarm device is arranged is formed, for example by glass or a space to be protected, for example the interior of a room or a car. On or in the medium there are arranged a transmitter 3 and a receiver 4 which may consist of the same elements or of separate elements and which are connected to a central unit 2. The central unit comprises a control member 5, an output of which is connected to an alarm generator 9 which controls a signal source, for example an alarm bell or an alarm lamp 10. The central unit 2 also comprises a signal source 6, for example a piezoelectric crystal which is connected to the control member 5. The signal source supplies the transmitter 3 with a pulse train having a predetermined pulse frequency $f_0$. This signal is preferably formed by a sinusoidal signal or by a signal which is composed of a plurality of sine waves and which is treated in accordance with the known Fourier analysis method. The control member is also connected to a sampling unit 8, an input of which is connected to the receiver 4 via a zero crossing detector 7, a further input being connected to an output of the signal source 6.

The transmitter 3 transmits the pulse train having a pulse frequency $f_0$ through the medium. The receiver 4 receives the pulse train which is transported through the medium and which is formed by a wave group. If no changes occur in the medium, hardly any change will occur in the wave group received. However, if a change occurs in the medium, for example due to a glass fracture or the presence of an intruder, changes will occur in the wave group, for example phase shifts or amplitude changes. For the analysis of the wave group received the central unit comprises a zero crossing detector 7 which analyzes the wave group received as regards zero crossings and which encodes a negative value, for example as a logic "O" and a positive value as a logic "1". The zero crossing detector thus also acts as an analog-to-digital converter. The bit stream supplied by the zero crossing detector is sampled by sampling unit 8 with a sampling frequency $f_1$ which amounts to a multiple of the pulse frequency $f_0$. The sampling frequency preferably amounts to three times the pulse frequency $f_0$. The frequency $f_1=3f_0$ is attractive because it enables a reasonably reliable analysis of the signal received, as will be described in detail hereinafter. The samples taken by the sampling unit are applied to the control member 5 for further processing.

FIG. 2 shows an embodiment of the control member 5. It comprises a control unit 20, for example a microprocessor, for controlling the further elements of the control member. The control member also comprises a communication bus (data bus+address) 28 whereto there are connected a first memory 22, a reference memory 23, a register 27, a first counter 21 and a second counter 26, and the control unit 20. The sampling unit 8 is also connected to the communication bus. An output of the register 27 is connected to an address input of a further memory 24, a data output of which is connected to a counter system 25. A result output of the counter system 25 is connected to the control unit 20.

The encoding of the changes occurring in the wave group received due to changes in the medium will first be described and subsequently the operation of the actual control member.

For various reasons, for example temperature fluctuations, fluctuations in the degree of humidity, vibrations in the medium, the presence of intruders or a fracture when the medium consists of glass or another acoustically hard material, shifts in time and/or amplitude variations occur between successively received wave groups. Sampling of the wave group received and analysis of the samples taken from successive wave groups enable the alarm device to detect these changes. The control member is capable of analyzing such changes and of distinguishing such changes from one another in order to generate an alarm exclusively if an actual alarm situation occurs (fracture, intruder, etc.).

The analysis of such a change in successive wave groups is performed by sub-dividing the wave group into sub-periods and by comparing such a sub-period each time with a corresponding sub-period of a wave group received during a preceding cycle. During such a comparison it is checked whether the signal component of the relevant sub-period has been shifted in time with respect to the signal component of the preceding cycle. The shift in time of such a signal component can be an advancement as well as a retardation.

FIG. 2*a* shows such a shift in time. In FIG. 2*a* the time is plotted along the horizontal axis and the amplitude is plotted along the vertical axis. The wave a, serving a reference, reaches its maximum amplitude at the instant $t_2$. Wave b reaches its maximum amplitude at the instant $t_1$, so that it has been shifted $\Delta T_1=t_2-t_1$ in time with respect to the wave a. Because $t_1$ precedes $t_2$ in time, the wave b has been advanced with respect to the wave a. Wave c reaches its maximum amplitude at the instant $t_3$, so that it has been delayed $\Delta T_2=t_3-t_2$ in time with respect to $t_2$.

Such a shift in time is recognizable, for example by considering phase shifts having occurred in a mainly sinusoidal signal. FIG. 3 (*a–f*) shows six sinusoidal wave signals, the phase of each sinusoidal wave having been shifted 60° with respect to its predecessor; for example, the wave shown in FIG. 3*c* has been phase shifted 60° with respect to the wave shown in FIG. 3*b*. The phase angle range of the wave signal has thus been subdivided into six successive 60° intervals. Adjacent each wave there is stated the value as taken by the sampling unit, the encoding by the zero crossing detector again being used for this purpose ("1" for positive value, "0" for negative value). This value forms a characteristic sub-pattern word wherefrom the phase wherethrough the signal component has been shifted with respect to the reference signal component (FIG. 3*a*) can be recognized. This phase shift in a detected signal component can be encoded by assigning a weight and a sign thereto. The weight represents each time the degree of phase shift in the signal with respect to the nonshifted wave shown in FIG. 3*a*. A variation in the weight means that in any case a change occurs in the bits of the characteristic pattern word. The sign indicates the direction in which the phase shift has taken place. If the difference ($\phi-\phi a$) between the phase of $\phi a$ (FIG. 3*a*) and the phase $\phi$ of one of the other waves (*b–f*) is positive or negative, a "−" and a "+", respectively, are assigned thereto. The weight and the sign thus together constitute a code number. Adjacent each wave in FIG.

3 the code number assigned to the relevant phase shift is stated.

Because a code number has been assigned to a phase, the phase shift can be encoded from successive samples. FIG. 4 shows a table containing the various feasible phase shifts. When the result of a sampling of a signal component received is 011 (corresponding to a phase shift of 120°) and the result of a subsequent sampling of a signal component received is 001 (phase shift of 180°), a phase shift of 180° − 120° = 60° has occurred between the successive samples. The code number −1 is then assigned to this shift (2nd row, $4^{th}$ column). Analogously, a phase shift of 240° (or −120°) (101), followed by a phase shift of 120° (011) is encoded as (120° − 240° = −120°), represented by the code number +2 ($3^{rd}$ row, $6^{th}$ column). The table shown in FIG. 4 has been drafted in this manner.

The table of FIG. 4 shows not only the sampling values of FIG. 3 but also the values 000 and 111. The value 000 occurs when no zero crossings have been observed by the zero crossing detector, for example when no signal has been detected by the receiver. The value 111 occurs when only signals having a positive value have been detected; this occurs, for example when a phase jump has occurred in the signal received.

When a shift is observed from and/or to one of these sampling values 000 or 111, this shift is encoded in a special way as shown in the table of FIG. 4. For example, the code number $V_4$ is assigned to a shift of one of the sampling values 001, 010, 011, 100, 101 or 110 to 000 or 111, indicating the disappearance of the response to a transmitted signal. To a shift from 000 or 111 to one of the sampling values 001, 010, 011, 100, 101 or 110 there is assigned the code number $V_5$, indicating the reappearance of the response to a transmitted signal. The code number $V_6$ is assigned to a stationary state (000→000 or 111→111). Such a stationary state can occur, for example during intialization or in the case of a defect in the transmitter and/or the receiver. A shift from 000 to 111 or vise versa is encoded in the same way as a phase shift through 180° by assigning the code number 3 thereto. This assumption is based on the fact that in this situation actually a reversal or a 180° phase shift of the sampled signal occurs.

The table of FIG. 4 also illustrates why a sampling frequency $f_1 = 3f_0$ is attractive. If sampling were to take place with a frequency $2f_0$, the table would be formed only by a 4×4 matrix, so that the number of detectable shifts would be smaller. As a result, it would be more difficult to determine exactly in which direction shifts have occurred and to what extent. Moreover, in the case of a sampling frequency $2f_0$ the risk is high that sampling always takes place on the wave edge of the zero crossing, so that the reliability of the sample value is affected. When a sampling frequency $>3f_0$ is chosen, however, more code numbers will occur and the analysis of the signal received will be more accurate, but the complexity of the matrix table will also increase substantially. Shifts in the amplitude of the signal received can be encoded in the same way as phase shifts.

The operation of the control member shown in FIG. 2 will be described in detail hereinafter with reference to the flowchart shown in FIG. 5. The flowchart represents a control program which is stored, for example in the memory of the control unit 20. The control program is started (30) as soon as the alarm device is operational. The control unit subsequently determines (31) the sampling frequency ($f_1$) on the basis of the frequency of the transmitted signal. The number of m successive sampling periods to be considered for an observation cycle is also determined; for this purpose the control unit sets an internal counter to the value m. During such an observation cycle, at corresponding instants in each of the m successive sampling periods a predetermined number of n, (for example, n = 1023) samples are taken from the signal received by the receiver, using the zero crossing detector. The number of sampling periods within an observation cycle amounts to, for example 1, 32, 64, 128 or 256, depending on the medium being monitored and also on the required speed of response of the alarm device. For example, when the medium is formed by glass, m = 32 because fast and reliable detection of a glass fracture is desirable. However, if the medium is formed by the interior of a room, m = 128 or 256, because even more accurate detection is thus possible.

The control unit then activates (32) the transmitter for transmitting a pulse train having a pulse frequency $f_0$. After expiration of a predetermined period of time after the transmission of a pulse train by the transmitter, the control unit starts (33) a sampling period of, for example T = 2.8 ms for taking n (= 1023) samples. By utilizing an observation cycle and by performing each sampling operation in correlation with the transmission of the pulse train, i.e. each time at a fixed instant after the transmission of a signal, the non-correlated signals present in the sampling values are removed by averaging. By performing the sampling operations in correlation with the transmission of the pulse train in the various cycles, the samples will be taken each time within one and the same sub-period of the signal received. At the start of a sampling period, the control unit activates a clock 29 which applies a clock signal having the frequency f, to the first counter 21 and the sampling unit 8. In synchronism with the clock signal, the first counter 21 generates address signals for addressing memory locations in the first register memory 22. Because the first counter and the sampling unit receive the same clock signal, they will operate in synchronism so that each of the n sampling values will always be stored in a defined location in the first memory.

After the execution of the step 33 of the control program, the control unit checks (34) whether all m periods of the observation cycle have been dealt with. If this is not the case, the internal counter which counts the cycle periods m is incremented by one unit, the first counter 21 is reset to zero, and the second counter 26 is activated (35). The control unit then starts a next sampling period during which a pulse train is transmitted again (32). During the second sampling period of the same observation cycle and during any further sampling period thereof, the sampling value will not be stored directly in the first register memory. The memory locations of the first memory which are indicated by the first counter are read first and the contents thereof are applied to the second counter 26 which also receives the new sampling value. The two values presented are added by the second counter and the result is stored in the memory location read previously. As a result, after completion of the observation cycle each memory location will contain the sum value of the sampling values taken for the relevant sub-period. It is alternatively possible to activate the second counter already during the first period, because during this first period the second counter will then add the value 0 to the sampling value.

When all m periods of an observation cycle have been dealt with (34Y), the control unit again initializes (36) the first counter 21 in order to address a first memory location of the first register memory 22 again and to determine (37) for the relevant memory location the mean value of the sum values stored therein. This mean value can be determined either by dividing the sum value by m or by fetching the most significant bit (MSB) of the sum value. This is because, when a logic "1" has been taken during each sampling operation, MSB="1"; if not, MSB="0". The mean value is subsequently stored (38) in the register 27. The address determined by the first counter 21 is also used for addressing (39) the reference memory 23. The value stored therein is transferred to the register 27 for storage. Subsequently, at the addressed location of the reference memory the mean value determined immediately previously is stored. In the register 27 the mean value and the value from the reference memory 23 are stored in a predetermined location as will be described hereinafter.

Subsequently, the control unit checks (40) whether the first counter 21 indicates a value which is a multiple of 3. If this is not the case (40N), the first counter 21 is incremented by one unit (41) and the control program is resumed as from the step 37 in order to determine the mean value for a next memory location of the first memory 22 and to store two further bit values in the register 27.

When the check of the step 40 reveals that the first counter 21 indicates a value which is a multiple of 3 (40Y), the register 27 will contain 6 bits, three bits originating from the reference memory 23 and three bits originating from the mean value as determined from the sum values stored in the first memory 22. The three bits from the mean value and the reference value, respectively, each time form a sub-pattern word which represents a signal component from a sub-period. The three bits from the mean value represent an actual sampling value as described with reference to FIG. 2. The sub-pattern word from the reference memory represents a previous sampling value because each time the newly calculated value is loaded into the reference memory. As has been explained with reference to FIG. 4, a code number can be assigned to this combination of two sub-pattern words. The location in which the various bits are written in the memory 27, therefore, is important in order to indicate the correct location in the matrix. All bits determined from the mean value form a pattern word which becomes a reference pattern word when stored in the reference memory.

The two sub-pattern words in the register 27 thus form a combination word which in its turn forms an address for addressing (42) a location in the second memory 24. The table shown in FIG. 4 is stored in the second memory. The address formed by the combination word indicates a code number in the second memory. This code number addresses (43) the associated counter in the counter system 25 and increments the count by one unit. For each code number present in the second memory the counter system 25 comprises a counter which is addressable by its respective code number. Subsequently, it is checked (44) whether all memory locations of the first memory have been addressed; if not (44N), the control program is resumed as from the step 37. As a result, the n-bit pattern word is sub-divided into a number of 3-bit sub-pattern words and a sub-pattern word formed from mean values is combined each time with a sub-pattern word from the reference register. A shift can thus each time be detected and encoded. At the end of an observation cycle the various counter positions will provide an impression of the shifts found. By bit-wise loading each time a new pattern word into the reference memory, moreover, continuous shifts are taken into account and actual alarm situations can indeed be distinguished more accurately from false alarm situations.

When all memory locations of the first memory have been addressed (44Y) so that the actual pattern word has been completely formed and stored in the reference memory 23, each of the various counters of the counter system 25 will indicate how many times its associated code number has been assigned during the observation cycle. The evaluation phase of the observation cycle can then be executed.

Under the control of the control unit 20 the first counter 21 is reset to zero (45) in order to enable the start of a new cycle at a later stage. Subsequently, the control unit fetches the counts of the counters associated with positive code numbers (S3, S2, S1, S0) from the counter position 25 and sums these numbers (46). This first sum value ($\Sigma R+$) is stored in a first register of the control unit. Subsequently, the counts of the counters associated with negative code numbers (S-2, S-1) are fetched from the counter system 25 so as to be summed (47). This second sum value ($\Sigma R-$) is stored in a second register of the control unit. Furthermore, the counts of the counters S2, S3 and S-2 are fetched and summed (48), thus forming a sum number (M2+3) which is stored in a third register of the control unit. The control unit subsequently determines (49) a ratio factor $$Q=\Sigma R+/\Sigma R-.$$

This ratio factor indicates the direction of the shift of the phase during the observation cycle with respect to the previous observation cycle. If $Q\approx 1$, approximately as many positive as negative phase shifts have taken place, which clearly characterizes a noncontinuous shift patter. If $Q>>1$ or $Q<<1$, a continuous shift pattern in the one or the other direction is concerned. This shift pattern is usually caused by temperature fluctuations or fluctuations in the degree of humidity in the medium, so that they should not be considered as alarm situations. However, a value $Q\approx 1$ does indicate an alarm situation, because no continuous shift pattern in a defined direction is concerned.

When the sum number M2+3 is small, for example smaller than 20 for a total number of observations of approximately 340, only few major (larger than 60°) phase have occurred, so that there will not be an alarm situation. However, if the sum number M2+3 is large, many shifts of ±120° or ±180° have taken place during the relevant observation cycle, so that obviously an alarm situation is concerned.

These two criteria, that is to say the ratio factor Q and the sum number M2+3, will be used as an alarm criterion for activating the alarm generator or not. FIG. 6 illustrates such an alarm criterion. This Figure shows a graph in which the ratio factor Q is plotted on the horizontal axis and the sum number M2+3 is plotted on the vertical axis. The shaded area represents the alarm zone. When the combination formed by the pair Q, M2+3 is situated within the shaded area (for example, (Q, M2+3)=(1,40)), the generator 9 will be activated.

This alarm criterion is stored either in a memory of the control unit or in a separate memory provided for this purpose. The pair Q, M2+3 then forms an address for the relevant memory. For the pairs of numbers situated within the shaded area, an alarm bit, for example a logic "1", is then stored at the addressed memory location for activation of the alarm generator. The inverted bit value of the alarm bit is then assigned to the other pairs of numbers which are not situated within the shaded area.

During step 50 of the control program (FIG. 5), the pair of numbers Q, M2+3 is formed for addressing the memory in which the alarm criterion is stored and the addressed memory location is read. If the alarm bit "1" is present in the addressed location (51Y), the alarm generator is activated (52). If a logic "0" is present at the addressed memory location (51N), the first, second and third registers are erased (53), the counters of the counter system 25 are reset, and the control program is resumed as from the step 31. However, if the alarm generator is activated, subsequently the step 53 is also executed and the control program is resumed as from the step 31.

It will be apparent that other realizations of an alarm device in accordance with the invention are also feasible. A number of feasible alternatives will be described hereinafter (non-exhaustively).

For the alarm criterion, not only the pair of numbers Q, M2+3 can be used but also the further pair of numbers Q, M1, in combination with the first pair of numbers or not. The number M1 represents the sum of the counts S1 and S-1, and hence the sum of all phase shifts in the range between +60° and −60°. The number M1 can be determined, for example during the step 48 or during an additional step between the steps 48 and 49 of the control program. The alarm criterion for the further pair of numbers Q, M1 is given in FIG. 6. When both pairs of numbers (Q,M1; Q, M2+3) are used for alarm detection, either one address (Q, M1, M2+3) is formed when both criteria are stored in the same memory, or, when two memory locations are addressed, the values read are combined by means of a logic AND-gate. Depending on the requirement imposed on the alarm criterion, of course, a logic OR-gate can alternatively be used for this purpose.

It is alternatively possible to involve the code numbers $V_4$, $V_5$ and $V_6$ in the testing of the alarm criterion. FIG. 7 shows an extension of the control program of FIG. 5 in which the code numbers $V_4$, $V_5$ and $V_6$ are also involved. These program steps can be inserted, for example between the steps 44 and 45 of the control program. During the steps 80, 81, 82 it is checked whether the counts of the counters $V_6$, $V_5$, $V_4$, respectively, of the counter system 25 exceed a predetermined value P1 (for example, P1=100 if n=1024), P2 and P3, respectively (for example P2=100; P3=100, if n=1024). If one of these counts exceeds the predetermined value (Y), a warning signal is generated (83).

For the sake of completeness it is also to be stated that the alarm criteria shown in FIG. 6 have been determined on the basis of a series of measurement results. However, the invention is not restricted to a device incorporating only one or both these alarm criteria. Depending on the required sensitivity of the alarm device, the shaded area can be increased or decreased.

An alternative method of testing with respect to the alarm criterion utilizes a memory which is addressed by a value M2+3 and/or a value M1, limit values for the ratio factor Q being stored at the addressed memory location. The control unit then compares the ratio factor determined during the step 49 with the limit values read from the memory. When the calculated ratio factor has a value beyond the given limit value, the alarm generator is activated.

As has already been stated, an observation cycle comprises m sampling periods. In the flowchart shown in FIG. 5 a next sampling period is started immediately after expiration of one of the periods j ($1 \leqq j < m$). However, it is alternatively possible to vary the interval between the successive sampling periods of an observation cycle. The intervals between the various sampling periods can then be determined, for example by means of a random generator.

The monitoring device must be capable of being operative in different media. This means that the amplitude of the transmitted pulse train must be adjustable as a function of the medium. For example, when the monitoring device is formed by a glass fracture detector which is arranged against a window pane having a large surface area, the transmitter should transmit a pulse train consisting of pulses having an amplitude which is higher than in the case of a window pane having a smaller surface area, because the loss occurring is much higher in the case of the larger glass surface area.

FIG. 8 shows a control circuit for adjusting the amplitude of the pulses in the transmitted pulse train. The control circuit is controlled by the control unit 20 and comprises p logic AND-gates (90-1, 90-2, . . . 90-p). Preferably, p equals four, so that 16 different amplitude values can be adjusted and an adequate number of selection possibilities are available. Each of the logic AND-gates comprises a first input which is connected to the output of a tone generator 94 which supplies a wave signal having a fixed amplitude. A second input of each logic AND-gate is connected to the control unit 20 via the bus 28. Each of the logic AND-gates comprises an output which is connected to the base of a respective transistor 91-1, 91-2, . . . , 91-p. The emitter of each transistor is grounded and its collector is connected to a respective resistor 92-1, 92-2, . . . , 92-p. Each of these resistors has a different value; for example, the resistor 92-p has the value R=50Ω and the resistors 92-(p-1) and 92-2, 92-1 have the values 2R and $2^{p-1}$R, $2^{p}$R, respectively. It will be apparent that this choice of resistances is merely a preferred choice and that other values are also possible. The only requirement to be satisfied by the choice of these resistance values is that R(92-p)<R(92-(p-1))<. . . R(92-2)<R(92-1), because different amplitude values will be adjusted by means of these different resistance values, as will be described hereinafter. Furthermore, the various resistors are all connected to a common line 95 which is connected to one pole of the primary winding of a transformer 93. The other pole of this primary transformer winding is connected to a voltage source which supplies a supply voltage V which amounts to, for example 12 V. The transmitter 3 is connected to the secondary transformer winding.

The transistors operate as switching elements. When a signal having a logic value "1" is applied to a second input of a logic AND-gate, the signal output by the tone generator 94 will be applied to the base of the transistor connected to the relevant logic AND-gate. As a result, the transistor is turned on and a current path is formed which is extends from the voltage source and through the primary winding, the resistor and the transistor to ground. The current intensity of the current flowing through the path is determined substantially completely by the value of the resistor included in the current path.

Therefore, this current intensity is a measure of the current induced in the secondary winding and hence of the amplitude of the transmitted pulse train. The adjustment of the amplitude of the transmitter pulse train, therefore, can be determined completely by the control unit. This is because the current intensity through the primary winding of the transformer can be adjusted by the control unit by selection of the control signal applied to the second inputs of the logic AND-gates.

For example, when the amplitude control signal generator included in the microprocessor applies an amplitude control signal having the logic value "1" to the AND-gates 90-2 and 90-p and an amplitude control signal having the logic value "0" to the other AND-gates, the current paths through the resistors 92-2 and 92-p are formed. The current then flows through a parallel connection of these resistors and amounts to $$I = \frac{V(1 + 2^{p-1})}{(2^{p-1})R}$$

if a value R was chosen for the resistor 92-p and a value $(2^{p-1})R$ for the resistor 92-2.

The determination of the control signal applied to the logic AND-gates by the amplitude control signal generator will be described hereinafter with reference to the flowchart shown in FIG. 9. The flowchart represents an initialization routine which is executed, under the control of the control unit, each time when the monitoring device is switched on. As soon as the monitoring device is switched on (100), the control unit generates (101) a first control signal, a logic "1" being applied to the second input of the logic AND-gate 90-1 and a logic "0" to the second inputs of the other logic AND-gates. A current path is then formed through the resistor 92-1. Because this resistor 92-1 had the highest resistance ($2^pR$), only a weak current will flow through the primary winding of the transformer 93, so that a pulse train having only a low pulse amplitude is transmitted into the medium. Subsequently, the control unit executes (102) a routine in which the steps 31 to 50 of the control program shown in FIG. 5 are executed. Subsequently (103), the control unit checks whether the alarm criterion has been satisfied. This check is performed in the same way as described for the step 51 of the control program (FIG. 5). If this low-amplitude adjustment immediately leads to an alarm (Y), the amplitude of the transmitted pulse train is too low. The control unit will then generate (104) a second control signal in order to transmit a pulse train having a higher pulse amplitude. By the second control signal a logic "1" is presented to the second input of the logic AND-gate 90-2 and a logic "0" to the second inputs of the other logic AND-gates. The step 102 and 103 are then repeated in order to check whether this pulse train of higher amplitude again causes an alarm. If this is the case, the amplitude is increased once more. The steps 102, 103 and 104 are repeated until alarm is no longer detected in the step 103. This is because, if alarm is no longer detected, a pulse train having an adequate amplitude is transmitted through the medium. For generating the successive control signals, use is made of, for example a counter which, each time when the step 104 is executed, is incremented by one unit after having been initialized in the counter position 1 by the execution of the step 101.

The amplitude of the pulse train to be transmitted has thus actually been adjusted. This adjustment, however, can be refined by extending the initialization routine with the steps 105 to 108. If the adjusted amplitude has no longer resulted in an alarm (103N), the count of the counter V6 of the counter system 25 (FIG. 2) is fetched (105). As has already been explained, a code number V6 denotes a shift 000→000 or 111→111. Subsequently, it is checked (106) whether the code number V6 has already occurred too frequently. To this end, the count V6 is compared with a predetermined first reference value $V_R$ which amounts to, for example 15 if $n=1023$ and $m=32$. When the code number V6 has occurred more often (106Y) than indicated by the first reference value, the program proceeds to the step 104 in order to increase the amplitude of the adjusted pulse train slightly further. This is because the frequent occurence of the code number V6 within one and the same cycle indicates that the amplitude is just sufficient. In order to create a small safety margin, the amplitude of the transmitted pulse train is increased slightly further.

When the code number V6 has occurred less frequently than indicates by the first reference value (106N), the value $S_y=S_1+S_{-1}$ is determined (107). To this end, the counts of the counters $S_1$ and $S_{-1}$ are fetched and summed. Subsequently (108), the value $S_y$ is compared with a second reference value $V_z$ which amounts to, for example 10. If $S_y<V_z$ (108Y), the amplitude is increased again (104); if not, the initialization has been completed (109). An excessively large value of $S_y$ indicates an unstable signal.

A variety of circumstances, for example temperature fluctuations, changes in the degree of humidity of the medium etc. can influence the amplitude of the transmitted pulse train. As a result, the amplitude of the transmitted signal may become either too low so that the risk of a false alarm increases or too high so that energy is wasted or annoying side-effects occur, for example humming in the case of an ultrasonic transmitter. For periodic adaptation of the amplitude of the transmitted pulse train, the monitoring device in accordance with the invention preferably comprises a re-adjustment unit which is included in the control unit 20. The operation of this re-adjustment unit will be described in detail hereinafter with reference to the flowchart of a re-adjustment program shown in FIG. 10.

Re-adjustment of the amplitude of the transmitted pulse train takes place either each time after completion of a cycle of m sampling periods or after completion of a plurality of cycles, depending on the sensitivity of the medium. The re-adjustment program forms a sub-routine which, when executed, is performed prior to the execution of the step 53 of the control program (FIG. 5).

The re-adjustment program starts (120) by determining the sum $\Sigma=S_1+S_{-1}+S_2+S_{-2}+S_3$. To this end, the counts of the counters $S_1$, $S_{-1}$, $S_2$, $S_{-2}$ and $S_3$ are fetched and summed by way of a first counter. Subsequently, the control unit checks (121) whether the sum $\Sigma$ is larger than or equal to a reference value $T_A$ (for example, $T_A=10$ if $n=1024$ and $m=32$). This is because a sum value $\Sigma \geqq T_A$ indicates that a reasonable number of shifts have taken place. If $\Sigma \geqq T_A$ (121Y), a counter $T_1$ is incremented by one unit (122). Subsequently, it is checked (123) whether the counter $T_1$ has a count which is equal to a predetermined value $T_C$ (for example, $T_C=10$). If this is not the case (123N), the re-adjustment program is terminated and the program proceeds to the step 53 of the control program. However, if $T_C=10$ (123Y), it is checked (124) whether the amplitude of the pulse train has already been adjusted to a maximum value. To this end, the control signal applied to the control circuit (FIG. 8) is analyzed. If the amplitude has not been adjusted to a maximum level (124N), the amplitude of the pulse train to be transmitted in increased by one step (125) as described for the adjustment routine. However, if the amplitude has already been adjusted to a maximum level (124Y), this is indicated (126), for example by illumination of a pilot lamp on the monitoring device. However, the latter step is optional. After completion of the step 125 or 126, the counter $T_1$ is reset to zero (127). During the next cycles a pulse train having a higher amplitude (that is to say if the amplitude was not already maximum) will be transmitted.

However, if it is determined during the step 121 that $\Sigma < T_A$ (121N), it is subsequently checked (128) whether the counter $T_1$ indicates the value "0"; if not (128N), the count of the counter $T_1$ is decremented by one unit (129). This is because a value $\Sigma < T_A$ indicates that only few shifts have taken place, so that it can be checked whether the amplitude of the pulse train to be transmitted can be reduced in order to save energy. During the step 130 it is checked whether the sum $\Sigma$ is smaller than a predetermined value $T_B$ (for example, $T_B = 2$). If the sum $\Sigma$ is not smaller than $T_B$ (130N), it is checked (131) whether the count of a counter $T_2$ equals "0". The counter $T_2$ indicates the number of times that a sum $\Sigma < T_B$ has occurred. If the counter $T_2$ does not indicate the value "0" (131N), the count of the counter $T_2$ is decremented by one unit (132).

If the sum $\Sigma < T_B$ (130Y), the counter $T_2$ is incremented by one unit (133). Subsequently, it is checked (134) whether the count of the counter $T_2$ equals a predetermined value TD (for example, TD = 10). If this is the case (134Y), a sum $\Sigma < T_B$ has already occurred TD times, so that the amplitude of the pulse train to be transmitted may be reduced. During the step 135 it is checked whether the amplitude has already been adjusted to its minimum value. If this is not the case (135N), the amplitude is reduced (136), after which the counter $T_2$ is reset to the value "0" (137). The re-adjustment program thus enables the monitoring device to adjust each time an optimum amplitude for the pulse train to be transmitted.

What is claimed is:

1. A monitoring device, comprising a central unit means whereto there are connected a transmitter for periodically transmitting a pulse train into a medium to be monitored and a receiver for receiving the pulse train which is transported by the medium and which is formed by a wave group, which central unit means comprises a control member for controlling a monitoring device and a sampling unit which is connected to the receiver for taking in correlation with the transmission of the pulse train and each time within a sampling cycle, a series of n sampling values from the wave group received, where n is greater than 3 and for forming an actual pattern word from said series, which control member is connected to a signal generator and comprises a reference memory for storing a reference pattern word formed during a preceding cycle, which control member also comprises a control unit which is connected to the reference memory and which comprises a comparator, characterized in that the control unit also sub-divides the period of the wave group received into a further number of n/j sub-periods, where j is greater than 1, and sub-divides the actual pattern word and the reference pattern word into n/j j-bit first sub-pattern words and second sub-pattern words, respectively, each j-bit sub-pattern word representing a signal component in a respective sub-period of the wave group, which comparator forms each time a combination word from a first sub-pattern word and a second sub-pattern word originating from corresponding sub-periods, which comparator also comprises a code number generator means for assigning a code number from a predetermined series of code numbers to each combination word, which code numbers represent a respective measure of the shift in time of the signal components, as represented by the first sub-pattern word of their respective combination word, with respect to the signal component as represented by the second sub-pattern word of their respective combination word, which control member also comprises a counter system which is connected to the code number generator means and which is suitable for determining for each of the code numbers a first sum number which indicates the number of times that the relevant code number has been assigned within one and the same cycle, which control unit is suitable for checking whether the first sum numbers exceed limit values given by a predetermined criterion and for activating the signal generator when the criterion is exceeded.

2. A monitoring device as claimed in claim 1, characterized in that the control unit comprises a ratio factor generator for determining a ratio factor from the ratio of the first sum numbers associated with code numbers representing an advancement in time and the first sum numbers associated with code numbers representing a retardation, which control unit is also suitable for forming a second sum number by summing the sum values associated with code numbers representing shifts in a predetermined time interval, which control unit is also suitable for forming a combination number from the second sum number and the ratio factor and for activating the signal generator if said combination number forms part of a predetermined number of combination numbers.

3. A monitoring device as claimed in claim 2, characterized in that the control unit forms the second sum number by summing the sum values associated with code numbers representing a phase shift having an order of magnitude situated in the ranges (120°–180°), (180°–240°).

4. A monitoring device as claimed in claim 3, characterized in that said combination number is composed of the ratio factor, the second sum number and the further second sum number.

5. A monitoring device as claimed in claim 2, characterized in that the control unit is suitable for forming a further second sum number by summing sum values associated with code numbers representing a phase shift having an order of magnitude situated in the range between −60° and 60°.

6. A monitoring device as claimed in claim 5, characterized in that said combination number is composed of the ratio factor, the second sum number and the further second sum number.

7. A monitoring device as claimed in claim 2, characterized in that the control member comprises a memory in which indicators are stored in memory locations which are addressable by combination numbers forming part of said predetermined number of combination numbers, which indicators represent each time an activation signal for the signal generator.

8. A monitoring device as claimed in claim 1 or 2, characterized in that the pulse train to be transmitted is composed of a mainly sinusoidal wave pattern, the shifts in time as represented by the code numbers representing each time a phase shift within a predetermined phase range.

9. A monitoring device as claimed in claim 8, characterized in that the phase range is sub-divided into regions of each time 60° ($\pi/3$), a sub-pattern word being associated with each region thus formed.

10. A monitoring device as claimed in claim 9, characterized in that the control unit forms the second sum number by summing the sum values associated with code numbers representing a phase shift having an order of magnitude situated in the ranges (120°-180°), (180°-240°).

11. A monitoring device as claimed in claim 9, characterized in that the control unit is suitable for forming a further second sum number by summing sum values associated with code numbers representing a phase shift having an order of magnitude situated in the range between −60° and 60°.

12. A monitoring device as claimed in claim 8, characterized in that said series of code numbers comprises a first code number which represents the disappearance of the wave group received and a second code number which represents a phase jump in a signal component in the wave group received, the control unit being suitable for activating a warning signal if within a cycle said first or second code number has occurred a number of times which exceeds a predetermined number.

13. A monitoring device as claimed in claim 1, characterized in that the code number generator comprises a further memory in which the series of code numbers are stored and which can be addressed by an address formed by the combination word.

14. A monitoring device as claimed in claim 13, characterized in that the sampling frequency amounts to three times the pulse frequency of the transmitted pulse train.

15. A monitoring device as claimed in claim 1, in which the control member comprises a mean value determining unit for forming each time after completion of a cycle of m ($m>1$) sampling periods, a further series of n mean sampling values by determining a mean value from the sampling values taken in the corresponding further sub-periods of each of the m sampling periods of the same cycle, and for forming the actual pattern word from said further series, characterized in that the mean value determining device comprises a register memory having n memory locations, an address generator for generating, in synchronism with the taking of each of the $k^{th}$ ($1 \leqq k \leqq n$) sampling value by the sampling unit, each time a $k^{th}$ address for addressing the $k^{th}$ memory location of the register memory, and a counter which is connected to a data port of said register memory and to an output of the sampling unit, which mean value determining device is suitable for presenting, in response to the presentation of a sampling value originating from the sampling unit, the contents of the addressed memory location to the counter which is suitable for adding the sampling value presented to said contents presented, which mean value determining device is also suitable for storing the addition result of the counter at the addressed memory location.

16. A monitoring device as claimed in claim 1, characterized in that the sampling unit samples the wave group received with a frequency which is a multiple of the pulse frequency of the transmitted pulse train.

17. A monitoring device as claimed in claim 1, characterized in that the control unit comprises an amplitude control signal generator for generating a series of amplitude control signals, each control signal of the series indicating a well-defined amplitude of the pulses of the pulse train to be transmitted, which monitoring device comprises a control circuit, a control input of which is connected to the amplitude control signal generator in order to receive amplitude control signals, an output thereof being connected to the transmitter, which control circuit comprises adjusting means for adjusting, under the control of a control signal received, the pulse amplitude of the pulse train to be transmitted to a level indicated by the control signal received, which control unit is suitable for verifying, during an adjustment phase of the monitoring device, whether an amplitude adjusted by means of a selected amplitude control signal will lead to the predetermined criterion being exceeded, and for selecting, when the criterion is exceeded, a further amplitude control signal which represents a higher amplitude.

18. A monitoring device as claimed in claim 17, characterized in that the control unit comprises a readjustment unit which comprises a first counter for counting the total number of times that code numbers representing a shift in time which deviates from zero have occurred within a number of cycles, which readjustment unit is connected to the amplitude control signal generator and is suitable for selecting an amplitude control signal indicating a lower and a higher amplitude, respectively, if said total number of times within a further predetermined number of cycles is smaller and larger, respectively, than a predetermined number.

19. A monitoring device as claimed in claim 18, characterized in that the readjustment unit comprises a second counter and a third counter for counting the number of times that said total number of times is smaller and larger, respectively, than said predetermined number, which second counter and third counter supply a first control signal and a second control signal, respectively, when said further predetermined number is exceeded.

20. A monitoring device as claimed in claim 18 or 19, characterized in that the readjustment unit is suitable for checking, under the control of a first control signal and a second control signal, respectively, received, whether the selected amplitude control signal represents the lowest and the highest amplitude value, respectively, and for keeping the selected amplitide control signal the same if it represents such a lowest amplitude value and highest amplitude value, respectively.

21. A monitoring device as claimed in claim 17, characterized in that said series of code numbers comprises a first code number which represents the disappearance of the wave group received, the control unit being suitable for selecting a further amplitude signal which represents a higher amplitude if the first code number occurs more often than a predetermined number of times.

22. A monitoring device as claimed in claim 17 or 21, characterized in that the control circuit comprises a parallel connection of resistors, each of which has a different resistance value, each resistor comprising a first connection which is connected to a switching element which comprises a control input for receiving the amplitude control signal, a second connection being connectable to a power supply for the transmitter.

23. A central unit for use in a monitoring device as claimed in claim 1, characterized in that the control unit comprises a microprocessor.

24. A method for continuously monitoring a physical integrity of a medium, said method comprising the steps of:

(a) repeatably generating a standard source pattern of substantially periodic nature and limited length, and coupling said source pattern to said medium for transmission therethrough;

(b) for each source pattern, after said transmission sampling a received pattern on a sequence of sampling instants, each such sequence having a substantial identical time relationship with respect to the generation of the associated source pattern;

(c) digitizing the results of each sampling instant to a digitized value, for generating a sequence of digitized values;

(d) for each said sequence of digitized values, forming a set of sub-patterns, each set having a substantial identical time relationship with respect to the generation of the associated source pattern and each sub-pattern comprising at least two contiguous digitized values of their sequence of digitized values;

(e) between two sequences of digitized values associated to respective source patterns, comparing pairs of corresponding members of the sets of sub-patterns, and for each pair detecting either an identity, or an apparent signed phase shift not exceeding a predetermined amount, or another difference category; and (f) calculating an overall trend in said apparent phase shift, and an overall difference among the sequences of digitized values in question; generating an alarm signal in case said overall difference exceeds a standard difference value, wherein said standard difference value is smaller for a lower value of said overall trend and is higher for a higher value of said overall trend.

25. A method as claimed in claim 24, wherein all sub-patterns have a uniform number of digitized values.

26. A method as claimed in claim 25, wherein the occurrence period of said patterns in time substantially corresponds to the period of said source pattern.

27. A method as claimed in claim 25 or 26, wherein said uniform number is three.

28. A method as claimed in claim 26, wherein said predetermined amount of signed phase shift is $\pm 60°$.

29. A method as claimed in claim 25, wherein after said digitizing a succession of said sequences of digitized values is summed to generate a composite sequence which is thereafter processed in lieu of said sequence of digitized values.

30. A method as claimed in claim 29, wherein an earlier composite sequence is stored as a reference composite sequence for updating by a later composite sequence.

31. A method as claimed in claim 29, wherein said digitized values consist of one bit each, and said composite sequence is formed as a most significant bit of the result of summing said digitized values.

32. A method as claimed in claim 24, wherein said source pattern is substantially sinusoidal.

33. A method as claimed in claim 24, wherein said overall trend is calculated as the ratio between the respective numbers of apparent phase shifts of one and the other sign, respectively, and in that said standard difference is a symmetric function of said ratio.

34. A method as claimed in claim 24, wherein said other difference category comprises detection of an impossible combination of digitized values.

35. A method as claimed in claim 24, wherein said other difference category comprises detection of a phase jump.

36. A method as claimed in claim 34 or 35, wherein various difference categories carry different weight in calculating said overall difference.

37. A method as claimed in claim 24, wherein a feedback mechanism is provided for controlling the amplitude of said source pattern.

38. A method as claimed in claim 24, wherein said feedback mechanism is controlled by frequent occurrence of said other difference category.

* * * * *